US010786815B2

(12) United States Patent
Lompa et al.

(10) Patent No.: US 10,786,815 B2
(45) Date of Patent: Sep. 29, 2020

(54) ROTOR FOR A DISINTEGRATION DEVICE

(71) Applicant: KHD Humboldt Wedag GmbH, Cologne (DE)

(72) Inventors: Dieter Lompa, Cologne (DE); Rainer Kirchmann, Pulheim (DE)

(73) Assignee: KHD HUMBOLDT WEDAG GMBH, Cologne (DE)

( * ) Notice: Subject to any disclaimer, the term of this patent is extended or adjusted under 35 U.S.C. 154(b) by 320 days.

(21) Appl. No.: 15/763,640

(22) PCT Filed: Sep. 28, 2016

(86) PCT No.: PCT/EP2016/073140
§ 371 (c)(1),
(2) Date: Mar. 27, 2018

(87) PCT Pub. No.: WO2017/055365
PCT Pub. Date: Apr. 6, 2017

(65) Prior Publication Data

US 2018/0280985 A1 Oct. 4, 2018

(30) Foreign Application Priority Data

Sep. 29, 2015 (DE) ..... 10 2015 012 588

(51) Int. Cl.
*B02C 13/04* (2006.01)
*B02C 13/16* (2006.01)
(Continued)

(52) U.S. Cl.
CPC ..... *B02C 13/04* (2013.01); *B02C 13/16* (2013.01); *B02C 13/26* (2013.01); *B02C 2013/2808* (2013.01)

(58) Field of Classification Search
CPC ..... B02C 2013/2808; B02C 13/04
See application file for complete search history.

(56) References Cited

U.S. PATENT DOCUMENTS 3,235,189 A * 2/1966 Rogers ..... B02C 13/04 241/188.1
3,533,565 A * 10/1970 Weiner ..... B02C 13/1807 241/44

(Continued)

FOREIGN PATENT DOCUMENTS

DE 2145868 3/1973
DE 2416499 10/1975

(Continued)

OTHER PUBLICATIONS

International Search Report, dated Dec. 5, 2016, priority document.

*Primary Examiner* — Adam J Eiseman
*Assistant Examiner* — Bobby Yeonjin Kim
(74) *Attorney, Agent, or Firm* — Greer, Burns & Crain, Ltd.

(57) ABSTRACT

A rotor for a device for disintegrating feed material, comprising a drive shaft, a plurality of rotor disks mounted on the drive shaft, and disintegration tools arranged in the region of the outer circumference of the rotor disks. A holding flange is provided for each rotor disk for connecting the rotor disk to the drive shaft, wherein the holding flange is permanently connected to the drive shaft and detachably connected to the rotor disk. Devices for disintegrating feed material, in particular impact hammer mills, may thus be operated with a rotor, in which the risk of a shaking out and a lateral wandering of the rotor disks is largely eliminated.

7 Claims, 4 Drawing Sheets

(51) Int. Cl.
*B02C 13/26* (2006.01)
*B02C 13/28* (2006.01)

(56) References Cited

U.S. PATENT DOCUMENTS

| | | | | | |
|---|---|---|---|---|---|
| 3,724,767 | A * | 4/1973 | Scarbrough | A01G 3/002 | 241/185.5 |
| 3,779,470 | A * | 12/1973 | Smits | B02C 13/28 | 241/191 |
| 6,527,210 | B1 * | 3/2003 | Mecklenfeld | B02C 13/28 | 241/194 |
| 2005/0051651 | A1 * | 3/2005 | Enderle | B01F 7/00025 | 241/172 |
| 2009/0224089 | A1 | 9/2009 | Pallmann | | |
| 2014/0166795 | A1 * | 6/2014 | Mogan | B02C 13/28 | 241/191 |

FOREIGN PATENT DOCUMENTS

| | | | | |
|---|---|---|---|---|
| DE | 3938725 | | 5/1991 | |
| DE | 19848866 | | 4/2000 | |
| DE | 102006033300 | | 1/2008 | |
| EP | 2098297 | | 9/2009 | |
| GB | 159925 | A * | 3/1921 | B02C 13/00 |
| GB | 336776 | A * | 10/1930 | B02C 13/26 |

* cited by examiner

ROTOR FOR A DISINTEGRATION DEVICE

CROSS-REFERENCES TO RELATED APPLICATIONS

This application claims the benefit of the German patent application No. 10 2015 012 588.5 filed on Sep. 29, 2015, the entire disclosures of which are incorporated herein by way of reference.

BACKGROUND OF THE INVENTION

The invention relates to a rotor for a device for disintegrating feedstock, comprising a drive shaft, a plurality of rotor disks which sit on the drive shaft and disintegration tools which are arranged in the region of the outer circumference of the rotor disks; the invention additionally relates to a device for disintegrating feedstock.

Rotors are used in devices for disintegrating feedstock for the coarse or fine disintegration or deagglomeration of the feedstock as a result of beating forces, shear forces or impact forces. Disintegration tools such as blades, hammers or beating bars are arranged for this purpose in the outer circumferential region of the rotor disks, which are arranged as hubs on at least one drive shaft, on or between the rotor disks. The feedstock, for example scrap metal, textiles or granular feedstock, which is fed in the majority of cases radially to the rotating rotor, is grasped and disintegrated by the disintegrating tools of the rotor, often interacting with elements such as baffle plates (stator) which are arranged statically in the housing of the device. Thus, for instance, impact hammer mills are used in the course of cement production for preparing (disintegrating and simultaneous drying) the raw meal. Along with embodiments with beating bars, hammers, which are arranged on axial rods so as to oscillate, i.e., so as to be pivotable, are frequently provided in this case as disintegration tools which exert beating forces or impact forces on particles of the feedstock. Embodiments of impact hammer mills are taught, for example, in documents DE 24 16 499 C3 and DE 10 2006 033 300 A1.

The transmission of torque, relevant to the disintegration devices which are based on the rotor principle, from the driven shaft to the disintegration tools is effected via the rotor disks. Particular significance for effective and fault-free operation of the rotor and therefore of the disintegration device is consequently given to the connection between the rotor disks and the drive shaft. Frequently, the shaft-hub connection is realized by a feather key connection, that is to say, a transmission of torque by means of a feather key inserted into a groove, as, for example, taught in document DE 39 38 725 A1. In the normal case, the rotor disks, in this case, are pushed loosely onto the shaft and are secured at the sides against displacement, e.g., by way of stops, so that, in particular, as simple and rapid an assembly or disassembly of individual worn disks is possible. In particular, in the case of high torques that are typical to impact hammer mills and of forces that do not occur just radially due to the impact on the feedstock particles, however, there is a risk of the rotor disks deflecting out of their provided equilibrium position or operating position on account of the given play in the connection between the disks and the shaft, which can result in damage to the disks culminating in the shaft breaking. The disks creeping sideways cannot be ruled out either.

Similar difficulties can arise in the case of the rotor disclosed in document EP 2 098 297 B1 for disintegrating feedstock, including, in particular, a drive shaft, rotor disks and disintegration tools. Here, not all the rotor disks are fixedly connected to the shaft. Rather, a transmission of force takes places between the rotor disks, only the outer rotor disks being connected to the shaft by means of frictional locking. Deflection of the middle rotor disks in the case of particularly high torque and force loads can only be ruled out by particularly sturdy, expensive force connections between the disks. Over and above this, the proposed, complex clamping sets for producing the frictional locking of the outer disks have to enable a certain amount of slippage between shaft and rotor disks in the case of stresses occurring in a peak-like manner on account of the transmission of force between the disks themselves, which can also result in the disks leaving their provided operating position in a disadvantageous manner.

SUMMARY OF THE INVENTION

It is consequently an object of the invention to provide a rotor for a device for disintegrating feedstock, where the risk of the rotor disks deflecting and the rotor disks creeping out sideways is reduced.

According to the invention, it is therefore provided that in the case of the rotor, at least one retaining flange is provided for each rotor disk for connecting the rotor disk to the drive shaft, wherein the at least one retaining flange is connected non-detachably to the drive shaft and is connected detachably to the rotor disk. A departure is consequently made from the known forms of connection between drive shaft and rotor disks, such as the use of feather keys, on the one hand, in favor of the use of flanges which are fixedly connected to the shaft, as connecting parts between the shaft and the hubs held by the flanges, i.e., the rotor disks. In a particularly preferred embodiment of the invention, the retaining flanges are connected non-detachably to the shaft by means of weld connection. According to the invention, it is provided, on the other hand, that each rotor disk of the rotor is connected detachably to, in each case, at least one retaining flange. The transmission of torque from the drive shaft to the rotor disk takes place by means of the connection. The detachability of the connection here allows for the rapid, separate replacement of individual rotor disks which are exposed to heavy wear in operation, in particular on account of the repeated impact of particles of feedstock. As a result of the connection between every individual rotor disk and at least one retaining flange, each individual rotor disk is protected against sideways creeping. The expert will choose the strength of the connection corresponding to the forces and torques occurring during typical operation of the rotor in the disintegration device. Sideways creeping of the rotor disks as a result of the effect of non-radial forces, such as, for example, as typical in impact hammer mills on account of the flight paths of the feedstock, is prevented in this way in a more effective manner than when rotor disks are pushed loosely onto the shaft with stops provided at the sides.

In a preferred embodiment of the invention, the rotor disks are connected to the respective retaining flanges by means of a screw connection. This can occur by means of screws as a result of screw-connecting the rotor disk to the at least one retaining flange in a direct manner A connection which is to be preferred and is also sturdier, in particular against shear forces, as well as simpler to assemble, however, is producible by using one or multiple connecting parts which are designed as disks, brackets, plates or similar elements, overlap the shaft/hub connection of rotor disk and retaining flange at the side and are screw-connected in each case to the retaining flange and to the rotor disk. Retaining flanges and rotor disks are then sufficiently solid with one another but are connected detachably in an indirect manner. As a result of the connection according to the invention between every individual disk and at least one retaining flange, for example realized by means of screw connection, there are no loose rotor disks present in the rotor. As a result of the fixed, play-free connection between rotor disk and retaining flange, which acts as part of the shaft, the risk of the rotor disks moving out of their provided equilibrium position, that is to say of the rotor disks deflecting, is largely prevented. On account of the typically beating stress of the rotor in the case of impact hammer mills, this is extremely advantageous precisely for this type of disintegration device.

In one design of the invention, it is provided that the retaining flanges are realized in a circular manner about the shaft and each rotor disk is retained by precisely one retaining flange. The rotor disk, in this case, comprises a circular hub bore for the connection to the retaining flange. When viewed from the rotational axis of the shaft, each rotor disk comprises, as a result, a radial inner side, that is to say, an inner delimiting surface located toward the shaft—in the geometrically idealized case of a circular ring cylinder, the inner lateral surface. It is provided that in the shaft/hub system, the rotor disk rests by way of its radial inner side or inner surface on the radial outer side or outer surface of the associated retaining flange. For increased stability of the connection, the surfaces rest on one another as mating surfaces and therefore act as centering surfaces (for the positioning of the disks). The fit between shaft (retaining flange) and hub (rotor hub) can be a clearance fit with little play in the case of disintegration devices where only small forces and torques occur. In the normal case, in particular in the case of impact hammer mills, however, play-free connections in the form of transition fits are to be preferred, for reasons of the deflecting of the rotor disks which is to be avoided. An interference fit is only to be realized in exceptional cases of particularly large forces and torques; the disadvantage of the press fit thereof, in particular, is a costly assembly/disassembly of the rotor disks. The actual non-positive connection between the rotor disks and each of the corresponding retaining flanges is produced in the design of the invention by means of a screw connection, where the rotor disk and retaining flange are each fixedly screw-connected with one and the same connecting element. This can be, in particular, a plate which is arranged at the side and covers both rotor disk and the associated retaining flange in the region of the mating surfaces which rest one on top of another. A connecting plate in the form of a circular ring disk arranged concentrically to the rotor disk on one side of the rotor disk is, for example, suitable, the plate, for the purposes of simpler mountability, comprising multiple separate parts, for example of two semicircular ring disks. It seems reasonable to use a further multi-part connecting plate in an analogous manner on the other side of the disk or flange for further securing the screw connection and to tighten the nuts.

In a further design of the embodiment of the invention described above, arrangements are made which enable a relatively simple and rapid assembly of the rotor disks. During assembly, the rotor disks are pushed with the retaining flanges in the axial direction, i.e., longitudinally of the shaft, over the drive shaft. For this reason, each retaining flange comprises recesses (flange recesses) which are distributed over its outer circumference and are open radially outward and toward the side surfaces similarly as in the case of tuning forks or toothed wheels. Web-like parts of the retaining flange, designated as flange webs, remain between every two adjacent recesses in the outer circumferential region of the retaining flange. In an analogous manner, the rotor disk assigned to the respective retaining flange comprises recesses (disk recesses) and disk webs which are distributed over its inner circumference. In this case, flange recesses and flange webs correspond with the disk recesses and disk webs such that in the completely assembled rotor, that is to say in the operating state, the radial outer sides of the flange webs and the radial sides (located inward toward the shaft) of the corresponding disk webs rest one on top of another as centering surfaces with the already described fit. Accordingly, in this case, the recesses of rotor disk and retaining flange also adjoin one another and form common recesses. For a simplified assembly of the rotor disk on the associated retaining flange, the extents of the flange recesses provided along the circumference are dimensioned such that in at least one position of the rotor disk, rotated in relation to the assembled state, with respect to the retaining flange, each flange recess has situated opposite thereto a disk web with a smaller extent provided along the circumference. It follows that the corresponding disk recesses are also dimensioned such that each disk recess has located opposite thereto a flange web with a smaller extent provided along the circumference. For mounting, the rotor disk is therefore rotated in relation to the retaining flange such that the recesses of the disk can be guided above the webs of the flange and the recesses of the flange can be guided under the webs of the disk without blocking caused by friction during axial displacement. After being pushed-on in this way, the rotor disk is then rotated with respect to the retaining flange into the end position, where the outer surfaces of the corresponding webs rest on top of one another with fit as centering surfaces. In an advantageous manner, only a small depth of recess is required here for the screw connection.

In the typical case, the rotor disks and retaining flanges are each of the same design such that they match in form and size, i.e., are in each case congruent with one another. In an advantageous special realization of the afore-described design of the invention, the flange recesses are congruent with one another and the disk recesses are congruent with one another. In addition, to promote uniform material stress on the retaining flanges and on the rotor disks, the flange recesses, therefore also the disk recesses and the flange webs and the disk webs, are distributed uniformly on the circumference of every retaining flange or of every rotor disk. With reference to the distribution, there is therefore rotational symmetry or radial symmetry. For example, the recesses are arranged offset to one another at an angle of 60° with regard to rotation about the rotational axis of the shaft. For the simplification, provided as a result of play, of the assembly step of pushing a rotor disk over the retaining flange longitudinally of the drive shaft, it is sufficient and advantageous to the stability of the connection which is provided by centering surfaces that are as large as possible, when the flange recesses in (all dimensions of) their planar extent along the outer radial circumference are only a little larger than the (planar) extent of a flange web provided along the outer circumference. The same applies therefore to recesses and webs of the rotor disks and to the corresponding ratio of the corresponding portions of disks and flanges with respect to one another. In a preferred manner, the longitudinal extent of the recesses of the flanges or disks (with reference to the minimum dimension) is consequently to be chosen as between approximately 0.5% and a maximum of 10% greater than the extent of the webs (with reference to the maximum dimension thereof).

Such a dimension of webs and recesses is also possible where, in an alternative arrangement, the webs are pushed into the recesses in the manner of a plug-in connection. As a result of such interlocking, a connection, which is additionally also positive locking, is certainly produced between disks and flanges, but the production of the screw connection is made difficult.

The rotor according to the invention is suitable for all types of devices for disintegrating feedstock, the disintegration operation thereof is based on the rotation of a rotor fitted with disintegration tools, frequently in combination with a stator which is provided correspondingly in the housing or as the housing of the device. As a result of using a rotor in one of the embodiments according to the invention inside the disintegration unit of disintegration devices which are known per se and operate with the rotor principle, the invention also includes devices for the disintegration of feedstock which comprise a rotor according to the invention in one of the described embodiments.

As the rotor according to the invention is advantageous, in particular for use in impact hammer mills on account of the play-free connection between the rotor disks and the drive shaft, an advantageous design of the invention provides that the disintegration tools are present in the form of hammers. As known from generic hammer mills and impact hammer mills, the hammers, in this case, are arranged on axial rods so as to be pivotable, which axial rods penetrate the rotor disks, usually parallel to the drive shaft.

An important design of the device for disintegrating feedstock, which includes a rotor according to the invention, provides that the disintegration tools of the rotor are realized as hammers, beating bars or similar known striking tools and that the rotor has assigned thereto an impact hammer mill stator. The rotor according to the invention is therefore part of an impact hammer mill, the disintegration unit thereof also includes a stator which is typical to impact hammer mills, along with the rotor. For example, the stator comprises impact elements, such as, for example, beating bars, which are arranged fixedly in an additional impact chamber and by which the feedstock particles caught by the hammers of the rotor are centrifuged and as a result are (preliminarily) disintegrated.

BRIEF DESCRIPTION OF THE DRAWINGS

The invention is explained in more detail by way of the following figures, in which.

DETAILED DESCRIPTION OF THE PREFERRED EMBODIMENTS

Figure 1:
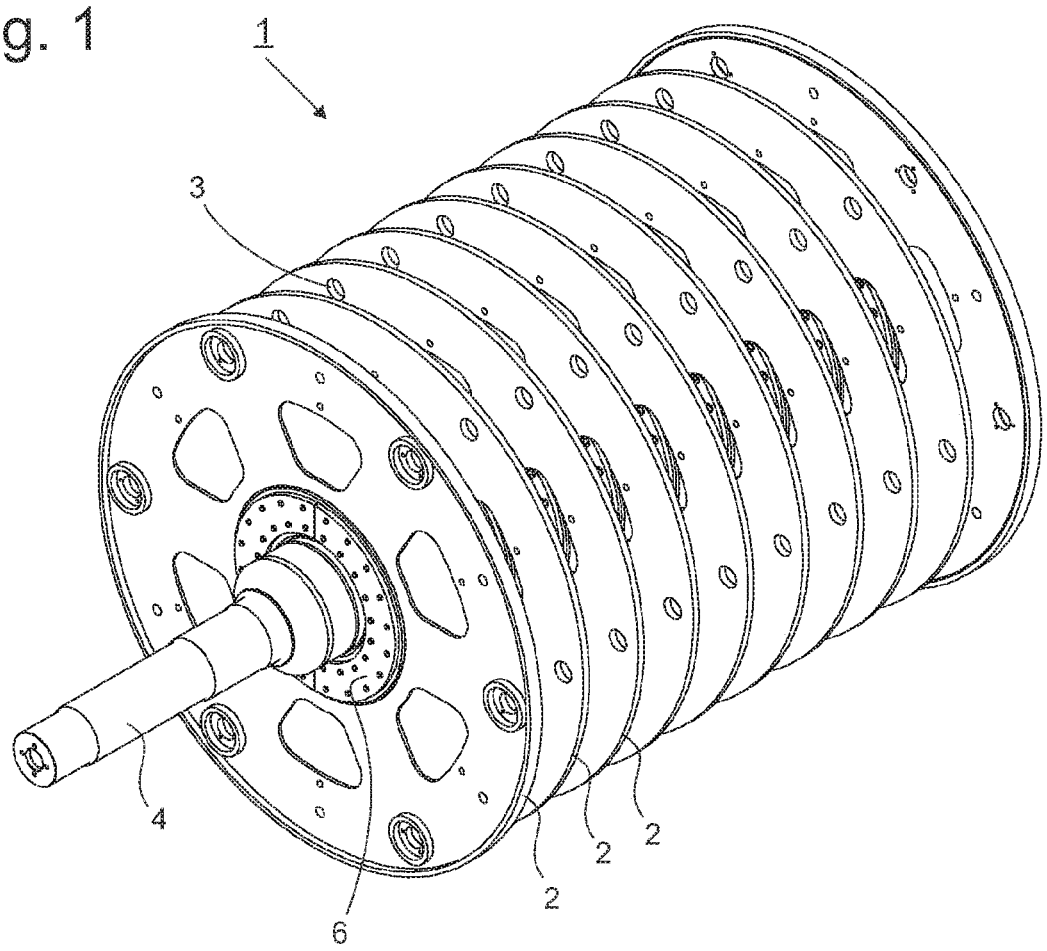
FIG. 1 shows a rotor according to the invention for a device for disintegrating feedstock.

FIG. 1 shows a rotor 1 according to the invention for a device for disintegrating feedstock, for instance for an impact hammer mill used in the production of cement. The disintegration tools are not shown. However, it is possible to see axial holes 3, which are arranged in the outer region of the rotor disks 2 and are provided for the axial rods 14 (FIG. 2) on which pivotable disintegration tools 16, in particular hammers, are arranged in the region between the rotor disks 2. When the rotor 1 is rotated, the hammers 16 pivot following the centrifugal force into a position directed radially outward, in which they project beyond the outer disk edge and act in a disintegrating manner on particles of the feedstock. The rotor disks 2 are arranged on a drive shaft 4. Each rotor disk 2, in this case, is arranged on a circular ring-shaped retaining flange 5. The rotor disk 2, in this case, comprises a circular hub bore 18 for the connection to the retaining flange 5.

Figure 3:
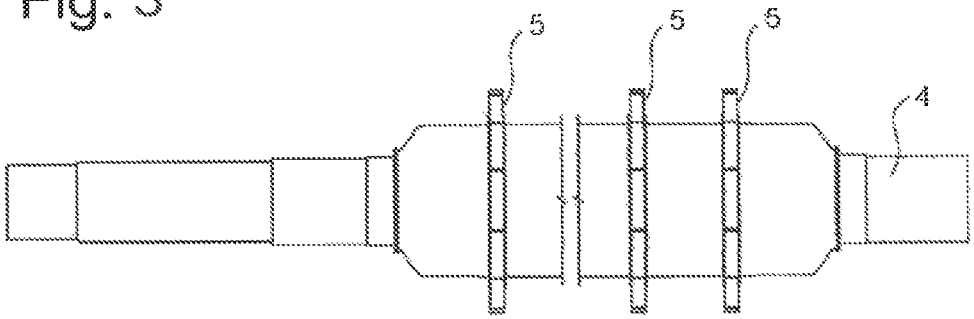
FIG. 3 shows a drive shaft with welded retaining flanges without rotor disks.

FIG. 3 shows a schematic representation of the retaining flange 5 on the drive shaft 4. According to the invention, the retaining flanges 5 are connected non-detachably to the drive shaft 4 as a result of welding.

Figure 2:
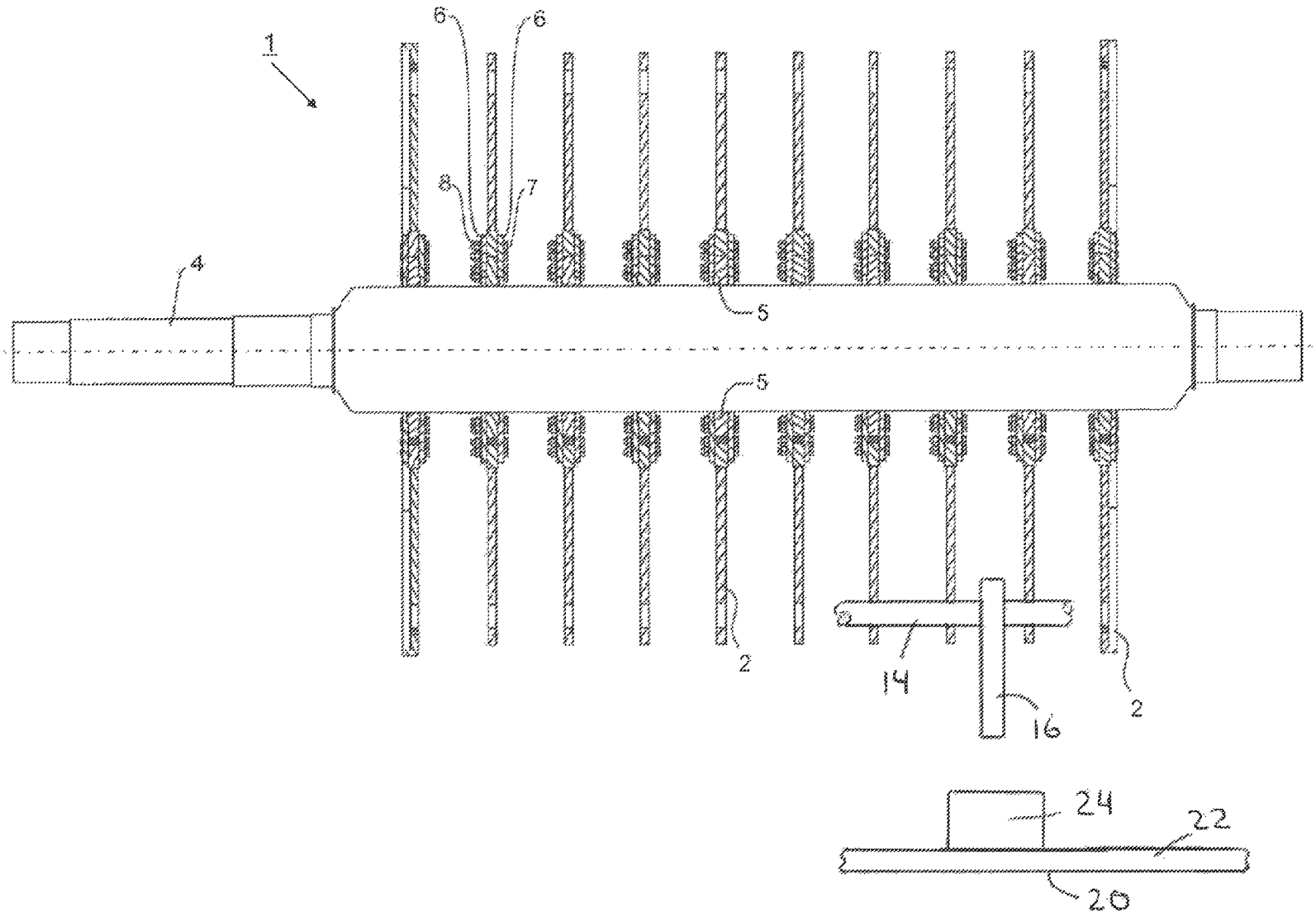
FIG. 2 shows a longitudinal sectional representation of the rotor with screw-connected rotor disks.

In FIG. 2, in a longitudinal section, which includes the rotational axis of the drive shaft 4, through the rotor 1 from FIG. 1, it is possible to see, in particular, the fixed, but detachable connection between the rotor disks 2 and 5 the assigned retaining flanges 5. In the region of the mating surfaces of rotor disk 2 and retaining flange 5, which lie one on top of another, a connecting element 6, which is realized as a connecting plate, is arranged, in this case, on each of the sides. Both rotor disk 2 and the associated retaining flange 5 are screw-connected to the connecting elements 6 by means of screws 7 and nuts 8. A play-free connection according to the invention is consequently produced between rotor disk 2 and retaining flange 5, by means of which play-free connection the forces and torques are transmitted and with which, in operation, even with the rotor 1 under beating stress, the rotor disks 2 do not deflect and no lateral creeping of the rotor disks 2 along the drive shaft 4 can occur. As shown in FIG. 1, the connecting elements 6, in the exemplary embodiment shown, are provided as circular ring disks which are realized in two parts for simple assembly.

Figure 4:
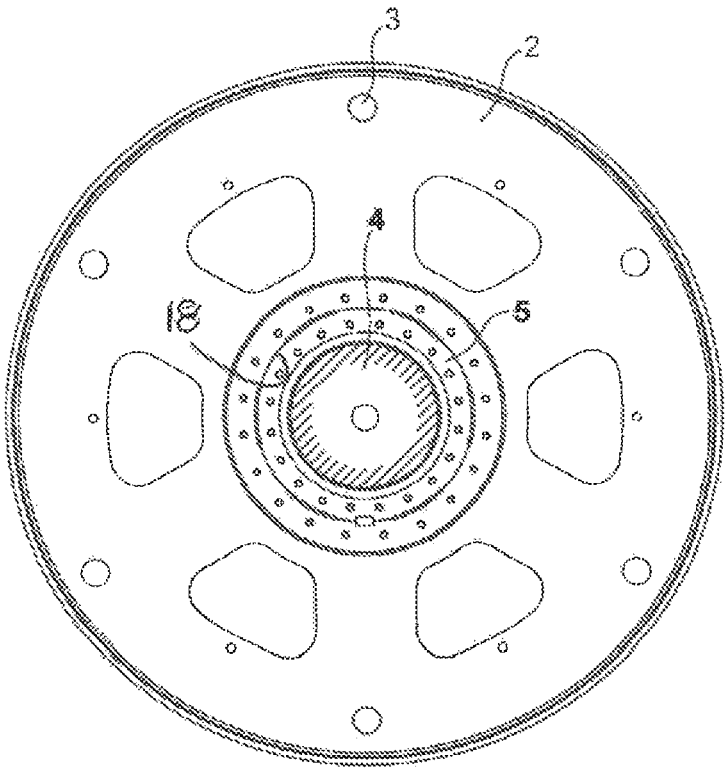
FIG. 4 shows a cross section through a rotor disk on a retaining flange.
Figure 5:
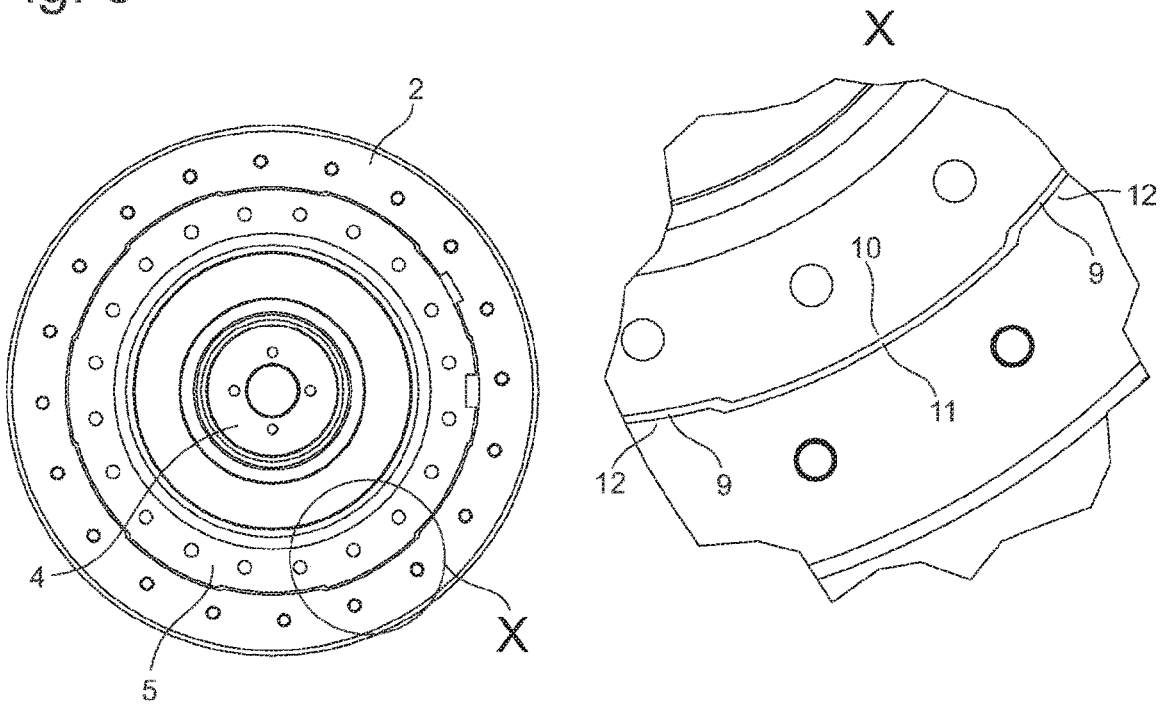
FIG. 5 shows a cross section through a rotor disk in the assembly position with respect to the retaining flange.
Figure 6:
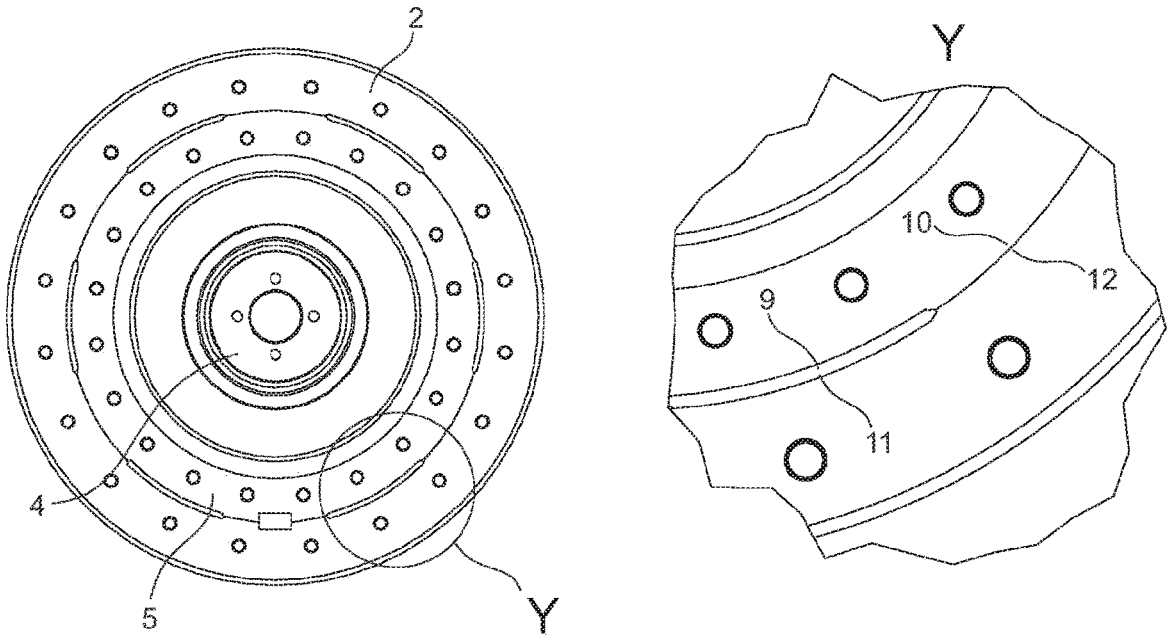
FIG. 6 shows a cross section through a rotor disk in the assembled position with respect to the retaining flange.

FIG. 4 shows a cross sectional representation of a rotor disk 2 which is connected to the drive shaft 4 by means of a retaining flange 5. Arrangements according to the invention for problem-free assembly of the rotor disks 2 into the operating position are shown in FIGS. 5 and 6, which are limited to the inner region, with the respective detail enlargements of regions X and Y. The retaining flange 5, in this case, comprises along its outer circumference uniformly distributed flange recesses 9 and flange webs 10 between every two adjacent flange recesses 9. Corresponding to this, the rotor disk 2 also comprises along its inner circumference correspondingly uniformly distributed disk recesses 11 and disk webs 12. The recesses 9, 11, in this case, with regard to their extent along the circumference, are slightly larger than the webs 10, 12 such that in the position of rotor disk 2 and retaining flange 5 with respect to one another, as shown in FIG. 5, a clearance fit is provided.

The position shown in FIG. 5 shows the position of the rotor disk 2, rotated with reference to the angle of rotation about the rotational axis of the shaft 4, with respect to the retaining flange 5. In this connection, flange recesses 9 and disk webs 12 or flange webs 10 and disk recesses 11 are situated opposite one another. This enables the rotor disks 2 to be pushed over or onto the retaining flange 5 in the axial direction in a largely low-friction, blockage-free manner 2 during assembly of the rotor disks 2.

In contrast to the assembly position from FIG. 5, FIG. 6 shows the position of rotor disks 2 and retaining flanges 5 in the completely assembled state, i.e., in the operating state. This is achieved by the rotor disk 2 being rotated out of the assembly position (FIG. 5) by such an amount that the flange webs 10 have located opposite thereto the corresponding disk webs 12 and therefore the flange recesses 9 have located opposite thereto the corresponding disk recesses 11. In the exemplary embodiment shown with 6 recesses (and 6 webs), this corresponds to a rotation about an angle of 30°. As a result, the achievement in the shaft/hub system is that the cover surfaces of the disk webs 12 and flange webs 10 rest one on top of another as mating surfaces or centering surfaces (FIG. 6), a play-free fit being provided. The play-free, fixed seat of the rotor disks 2 on the drive shaft 4 by means of retaining flanges 5, which is in particular advantageous for impact hammer mills, is consequently just as secured as a comparatively simple (disassembling) assembling of the rotor disks 2 which are exposed to wear.

An important design of a device 20 for disintegrating feedstock, which includes a rotor 1 according to the invention, provides that the disintegration tools 16 of the rotor are realized as hammers, beating bars or similar known striking tools and that the rotor has assigned thereto an impact hammer mill stator 22. The rotor 1 according to the invention is therefore part of an impact hammer mill 20, the disintegration unit thereof also includes a stator which is typical to impact hammer mills, along with the rotor. For example, the stator 22 comprises impact elements 24, such as, for example, beating bars, which are arranged fixedly in an additional impact chamber and by which the feedstock particles caught by the hammers 16 of the rotor 1 are centrifuged and as a result are (preliminarily) disintegrated.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCES

1 Rotor
2 Rotor disk
3 Axial hole
4 Drive shaft
5 Retaining flange
6 Connecting element
7 Screw
8 Nut
9 Flange recess
10 Flange web
11 Disk recess
12 Disk web

The invention claimed is:

1. A rotor for a device for disintegrating feedstock, comprising a drive shaft, a plurality of rotor disks which sit on the drive shaft and disintegration tools which are arranged in the region of the outer circumference of the rotor disks, wherein at least one retaining flange is provided for each rotor disk of the plurality of rotor disks for connecting the rotor disk to the drive shaft, wherein the at least one retaining flange is connected non-detachably to the drive shaft and is connected detachably to the rotor disk, wherein precisely one retaining flange is provided for each rotor disk of the plurality of rotor disks, wherein the retaining flange is realized in a circular manner about the drive shaft, wherein each rotor disk or the plurality of rotor disks rests with fit by way of its radial inner side, which is provided by a hub bore, on the radial outer side of the corresponding retaining flange, wherein each rotor disk of the plurality of rotor disks and the corresponding retaining flange are connected together in a play-free manner to at least one connecting element by means of a respective screw connection, wherein each retaining flange comprises open recesses which are distributed over the outer circumference, wherein every two adjacent flange recesses leave between them a flange web, wherein the rotor disk, which is assigned to the respective retaining flange, comprises open disk recesses and disk webs, which are distributed over an inner circumference of the rotor disk and correspond to the flange recesses and flange webs, wherein with the rotor in the assembled state, the radial sides of the flange webs and of the corresponding disk webs rest one on top of another as centering surfaces with fit, and wherein the extents of the flange recesses provided along the circumference are dimensioned such that in at least one position of the rotor disk, each flange recess has situated opposite thereto a disk web with a smaller extent provided along the circumference.

2. The rotor as claimed in claim 1, wherein the retaining flanges are connected to the drive shaft by means of a weld connection.

3. The rotor as claimed in claim 1, wherein the rotor disks are congruent to one another, the retaining flanges are congruent to one another, the flange recesses are distributed uniformly on the circumference of every retaining flange and are congruent to one another, the disk recesses are congruent to one another, and the extent of the flange recess provided along the outer circumference is greater than the extent of the flange web provided along the outer circumference.

4. The rotor as claimed in claim 1, wherein hammers are provided as disintegration tools, wherein the hammers are pivotably arranged on axial rods which penetrate the rotor disks.

5. A device for disintegrating feedstock comprising a rotor as claimed in claim 1.

6. The device for disintegration as claimed in claim 5, wherein the disintegration tools of the rotor are hammers, and the rotor has assigned thereto an impact hammer mill stator.

7. The rotor as claimed in claim 3, wherein the extent of the flange recess provided along the outer circumference is greater, by an extent of approximately 0.5% to 10%, than the extent of the flange web provided along the outer circumference.

* * * * *